US006887166B2

(12) United States Patent
Yu

(10) Patent No.: US 6,887,166 B2
(45) Date of Patent: May 3, 2005

(54) GOLF BALL

(76) Inventor: Qi Yu, 2446 San Gabriel Blvd., Unit A, Rosemead, CA (US) 91770

( * ) Notice: Subject to any disclaimer, the term of this patent is extended or adjusted under 35 U.S.C. 154(b) by 297 days.

(21) Appl. No.: 10/077,715

(22) Filed: Feb. 15, 2002

(65) Prior Publication Data

US 2003/0157999 A1 Aug. 21, 2003

(51) Int. Cl.[7] ..... A63B 37/00
(52) U.S. Cl. ..... 473/351
(58) Field of Search ..... 473/351, 371, 473/376, 378

(56) References Cited

U.S. PATENT DOCUMENTS 2,743,931 A * 5/1956 Pooley et al. ..... 473/280
2,753,599 A * 7/1956 Pietraszek et al. ..... 264/46.9
2,938,237 A * 5/1960 Kern et al. ..... 264/163
3,069,170 A * 12/1962 Dillon, Jr. ..... 473/280
4,256,304 A * 3/1981 Smith et al. ..... 473/451
5,645,496 A 7/1997 Endo et al.
5,681,898 A 10/1997 Pocklington
5,779,564 A * 7/1998 Nakamura et al. ..... 473/377
6,039,910 A 3/2000 Tanaka et al.
6,048,279 A 4/2000 Masutani
6,261,197 B1 * 7/2001 Grechko ..... 473/598
6,312,346 B1 11/2001 Sugimoto
6,458,052 B1 * 10/2002 Pitsenberger et al. ..... 473/598

* cited by examiner

*Primary Examiner*—Raeann Gorden
(74) *Attorney, Agent, or Firm*—Raymond Y. Chan; David and Raymond

(57) ABSTRACT

A golf ball includes a ball cover including a first and second hemispheric cups attached to each other to form a hollow spheroid and a solid ball core covered by the ball cover. Each of the first and second hemispheric cups has two semi-conical engagement edges fittingly engaged with two semi-conical connection edges of the other hemispheric cup so as to integrally unite the first hemispheric cup and the second hemispheric cup together to form the ball cover.

20 Claims, 4 Drawing Sheets

GOLF BALL

BACKGROUND OF THE PRESENT INVENTION

1. Field of Invention

The prevent invention relates to sport equipment, and more particularly to a golf ball which is capable of reducing the moment of inertia so as to enhance the spin motion thereof.

2. Description of Related Arts

Conventional golf balls are classified into thread wound golf balls and solid core golf balls. The solid golf ball, such as a two-piece solid golf ball, is generally approved or used by most of amateur golfers because of its long flying distance and excellent flying performance. Referring to FIG. 1, the conventional solid golf ball comprises a solid ball core and a ball cover covering the solid ball core. However, such conventional solid golf ball has several drawbacks.

In order to receive the solid ball core, having two halves cores C1, C2, in the ball cover, the ball cover is usually constructed by two hemispheric cups S1, S2 in such a manner that the solid ball core is covered with the two hemispheric cups S1, S2. Then, by sealedly attaching the hemispheric cups S1, S2 together in an edge to edge manner, the solid ball core is securely covered by the ball cover. However, a connection seam is formed on the circumference of the ball cover, which provides an uneven roundness of the golf ball. Especially every time when the golfer hits the golf ball, the golf ball will be preformed an irregular spin motion. Even though the manufacturer tries to minimize the irregular spin motion by altering the attachment of the hemispheric cups S1, S2, the connection seam cannot be eliminated due to the nature of connecting two physical matters together.

Moreover, when the spherical golf ball is required to be constructed by joining two semi-spherical halves, such as the ball cover or the solid ball core, to form a spheroid, the biggest problem is how to minimize the friction and torque formed therebetween during rotation and impact. Even applying extra strong adhesive between two connecting surfaces, such combined spheroid is still weak for torque.

SUMMARY OF THE PRESENT INVENTION

The main object of the present invention is to provide a golf ball, which comprises a ball cover constructed by two identical joint portions of two hemispheric cups united together with minimum friction between the contacting surfaces and minimized stress occurred at the connecting joint portions.

Another object of the present invention is to provide a golf ball which comprises a solid ball core constructed by two symmetrical pieces while minimizing the friction between all contacting surfaces and the stress of all connecting portion during rotation and impact.

Another object of the present invention is to provide a golf ball, wherein the two joint portions of two hemispheric cups are symmetrically identical that each provides a curved and smooth joint surface so as to enable the two joint portions to fittingly engage with each other integrally.

Another object of the present invention is to provide a golf ball, wherein the two hemispheric cups are perfectly and firmly connected together, so as to enhance the spin motion of the golf ball.

Accordingly, in order to accomplish the above objects, the present invention provides a golf ball, comprising:

a ball cover comprising a first hemispheric cup and a second hemispheric cup attached to the first hemispheric cup edge to edge to form a hollow spheroid; and a solid ball core covered by the ball cover;

wherein the first hemispheric cup has two identical first semi-conical engagement edges symmetrically outwardly projecting at two sides thereof and two identical first semi-conical connection edges inwardly projecting between the two first semi-conical engagement edges, wherein the two first semi-conical engagement edges are symmetrically and continuously extended between the two first semi-conical connection edges so as to form a continuous first joint edge for the first hemispheric cup;

wherein the second hemispheric cup has two identical second semi-conical engagement edges symmetrically outwardly projecting at two sides thereof and two identical second semi-conical connection edges inwardly projecting between the second first semi-conical engagement edge, wherein the two second semi-conical engagement edges are symmetrically and continuously extended between the two second semi-conical connection edges so as to form a continuous second joint edge for the second hemispheric cup;

wherein a cone height of each of the first and second semi-conical engagement edges is equal to a cone height of each of the first and second semi-conical connection edges, and the size and shape of the first hemispheric cup and the second hemispheric cup are identical and symmetrical, wherein the two second semi-conical engagement edges are fittingly engaged with the two first semi-conical connection edges respectively while the two second semi-conical connection edges are fittingly engaged with the two first semi-conical engagement edges respectively, so as to integrally unite the first hemispheric cup and the second hemispheric cup together to form the ball cover.

DETAILED DESCRIPTION OF THE PREFERRED EMBODIMENT

Figure 1:
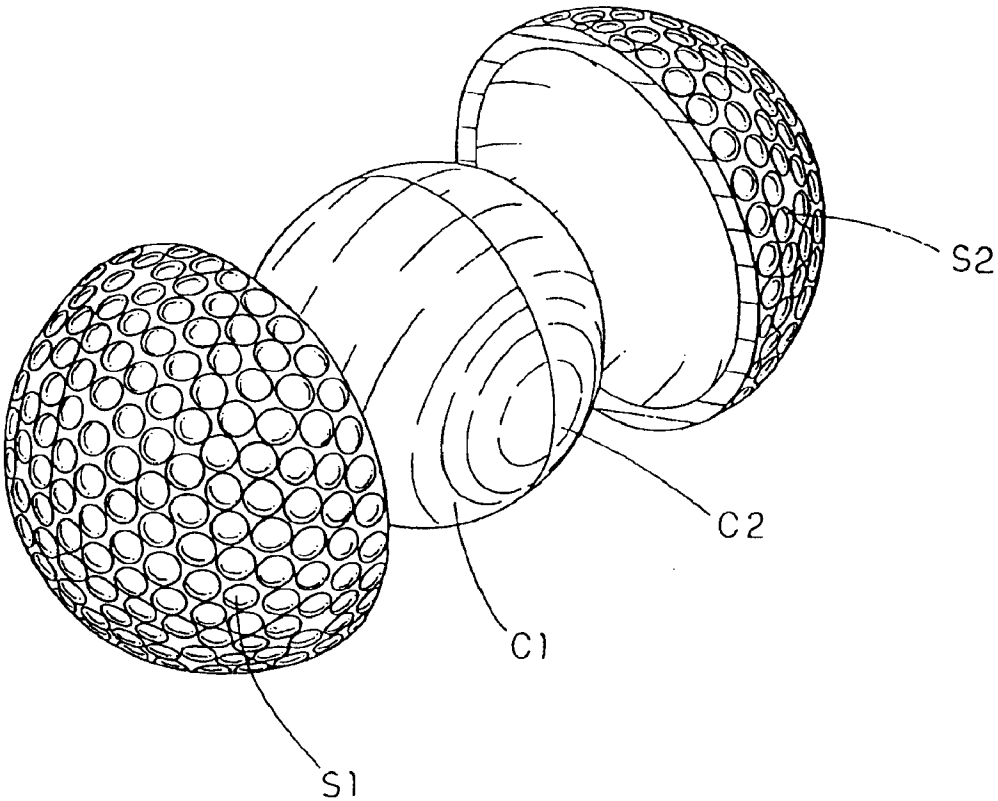
FIG 1 PRIOR ART
FIG. 1 is an exploded perspective view of a conventional golf ball.
Figure 2:
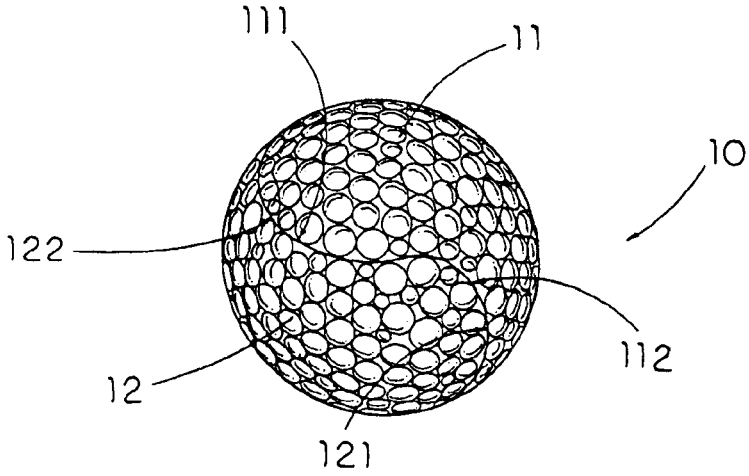
FIG. 2 is a perspective view of a golf ball according to a preferred embodiment of the present invention.

Referring to FIGS. 2 through 8, a golf ball according to a preferred embodiment of the present invention is illustrated, wherein the golf ball comprises a ball cover 10 comprising a first hemispheric cup 11 and a second hemispheric cup 12 attached to the first hemispheric cup 11 edge to edge to form a hollow spheroid and a solid ball core 20 covered by the ball cover 10.

Figure 3:
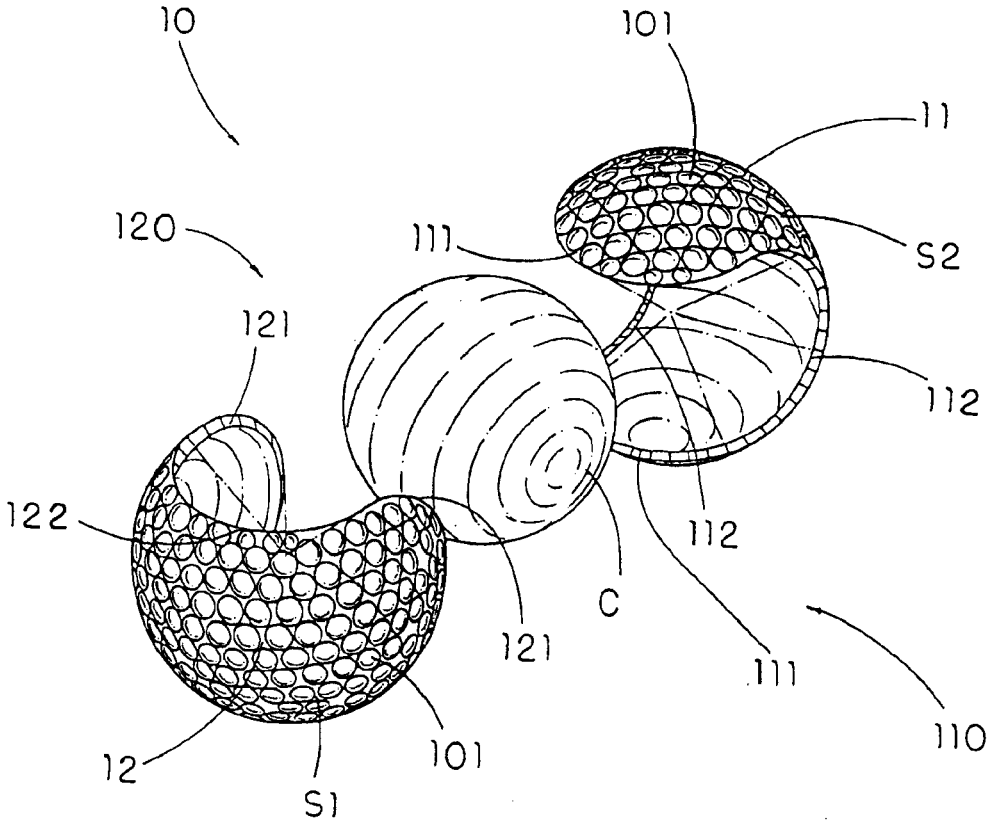
FIG. 3 is an exploded perspective view of a ball cover of the golf ball according to the above preferred embodiment of the present invention.

As shown in FIG. 3, the first hemispheric cup 11 has two identical first semiconical engagement edges 111 symmetrically outwardly projecting at two sides thereof and two identical first semi-conical connection edges 112 inwardly projecting between the two first semi-conical engagement edges 111.

The two first semi-conical engagement edges 111 are symmetrically and continuously extended between the two first semi-conical connection edges 112 so as to form a continuous first joint edge 110 for the first hemispheric cup 11.

The second hemispheric cup 12 has two identical second semi-conical engagement edges 121 symmetrically outwardly projecting at two sides thereof and two identical second semi-conical connection edges 122 inwardly projecting between the second first semi-conical engagement edges 121.

The two second semi-conical engagement edges 121 are symmetrically and continuously extended between the two second semi-conical connection edges 122 so as to form a continuous second joint edge 120 for the second hemispheric cup 12.

A cone height of each of the first and second semi-conical engagement edges 111, 121 is equal to a cone height of each of the first and second semi-conical connection edges 112, 122, and the size and shape of the first hemispheric cup 11 and the second hemispheric cup 12 are identical and symmetrical, so that the two second semi-conical engagement edges 121 are fittingly engaged with the two first semi-conical connection edges 112 respectively while the two second semi-conical connection edges 122 are fittingly engaged with the two first semi-conical engagement edges 111 respectively, so as to integrally unite the first hemispheric cup 11 and the second hemispheric cup 12 together to form the ball cover 10.

Accordingly, simply applying an axial pressure to attach the first and second hemispheric cups 11, 12 towards each other, the continuous first and second joint edges 110, 120 will be firmly joint together to form the ball cover 10. Since the continuous first and second joint edges 110, 120 share a common center point 100 and both contacting surfaces of the continuous first and second joint edges 110, 120 are curved and smooth edge surfaces extended radially for the center point 100 to the circumference of the ball cover 10, the continuous first joint edge 110 of the first hemispheric cup 11 is intercrossed with the continuous second joint edge 120 of the second hemispheric cup 12 that the first and second semi-conical engagement edges 111, 121 are respectively engaged with the second and first semi-conical connection edges 122, 112 with maximum contact surface area therebetween. Preferably, an attachment element such as glue is applied on each of the continuous first and second joint edges 110, 120 of the first and second hemispheric cups 11, 12 in order to securely and sealedly attach the first and second hemispheric cups 11, 12 together to form the hollow spheroid of the ball cover 10.

As shown in FIG. 3, each of the first and second hemispheric cups 11, 12 has a plurality of dimples 101 spacedly provided on the an outer circumferential surface thereof wherein the dimples 101 are provided along each of the continuous first and second joint edges 110, 120 of the first and second hemispheric cups 11, 12 respectively. In other words, each of the dimples 101 is not formed on a connection edge between the continuous first and second joint edges 110, 120 of the first and second hemispheric cups 11, 12 respectively.

The first and second hemispheric cups 11, 12 are arranged to cover the conventional solid ball core C in order to form the golf ball, wherein the center of the conventional solid ball core C is the center point 100 of the ball cover 10.

Figure 5:
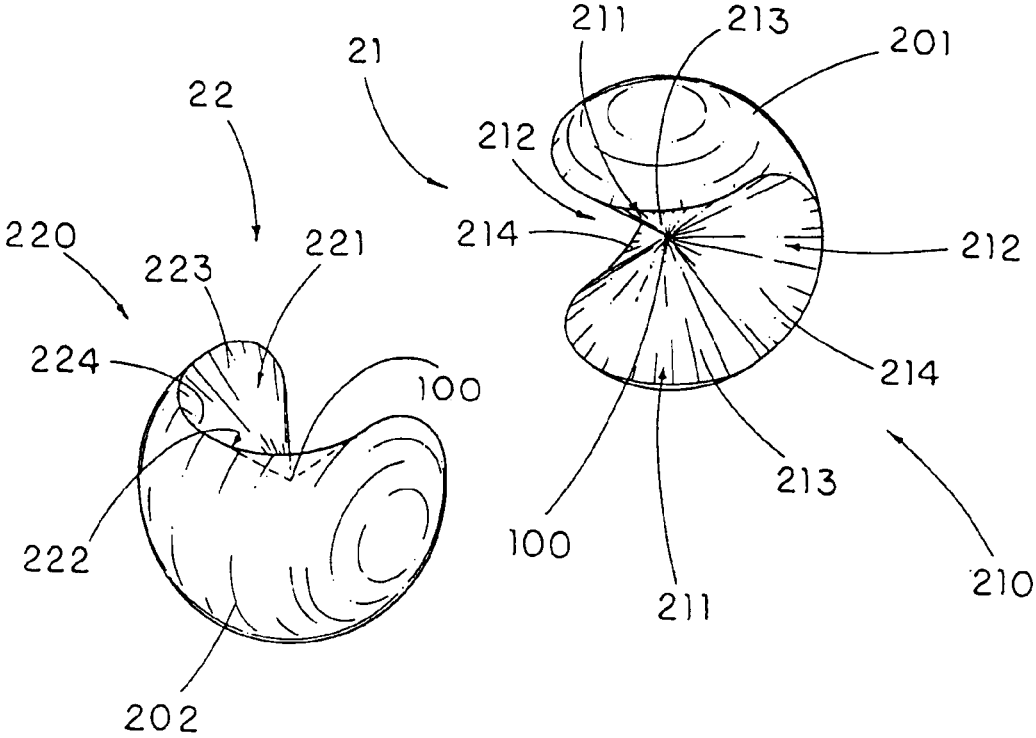
FIG. 5 is an exploded perspective view of a solid ball core of the golf ball according to the above preferred embodiment of the present invention.

As shown in FIG. 5, the solid ball core 20 comprises a first core body 201 and a second core body 202 attached to the first core body 201 to form a spheroid, wherein a radius of the solid ball core 20 must be slightly smaller than an inner radius of the ball cover 10, so that the solid ball core 20 is fittingly covered by the first and second hemispheric cups 11, 12 of the ball cover 10.

Accordingly, the first core body 201 has a first joint portion 21 which comprises two identical first semi-conical engagement tongues 211 symmetrically projecting at two sides thereof so as to define two identical first semi-engagement grooves 212 symmetrically indented between the two first semi-conical engagement tongues 211. The two first semi-conical engagement tongues 211 respectively define two first conically curved tongue surfaces 213 symmetrically facing with each other, and the two first semi-conical engagement grooves 212 respectively define two first conically curved groove surfaces 214 symmetrically and continuously extended between the two first conically curved tongue surfaces 213, so as to form a continuous first joint surface 210 for the first joint portion 21.

The second core body 202 has a second joint portion 22 which comprises two identical second semi-conical engagement tongues 221 symmetrically projecting at two sides thereof so as to define two identical second semi-engagement grooves 222 symmetrically indented between the two second semi-conical engagement tongues 221. The two second semi-conical engagement tongues 221 respectively define two second conically curved tongue surfaces 223 symmetrically facing with each other, and the two second semi-conical engagement grooves 222 respectively define two second conically curved groove surfaces 224 symmetrically and continuously extended between the two second conically curved tongue surfaces 223, so as to form a continuous second joint surface 220 for the second joint portion 22.

A cone height of each of the first and second semi-conical engagement tongues 211, 221 is equal to a cone height of each of the first and second semi-conical engagement grooves 212, 222, and thus the size of the shape of the first joint portion 21 and the second joint portion 22 are identical and symmetrical, so that the two second semi-conical engagement tongues 221 are fittingly engaged in the two first semi-conical engagement grooves 212 respectively while the first semi-conical engagement tongues 211 are fittingly engaged in the two second semi-conical engagement grooves 222 respectively, so as to integrally unite the first joint portion 21 and the second portion 22 together to form the spheroid of the solid ball core 20.

Accordingly, the solid ball core 20 is capable of forming the ball cover 10, by excavating center portions of the first and second bodies 201, 202 to form the first and second hemispheric cups 11, 12 respectively wherein each of the first and second hemispheric cups 11 has the uniformed thickness.

Figure 4:
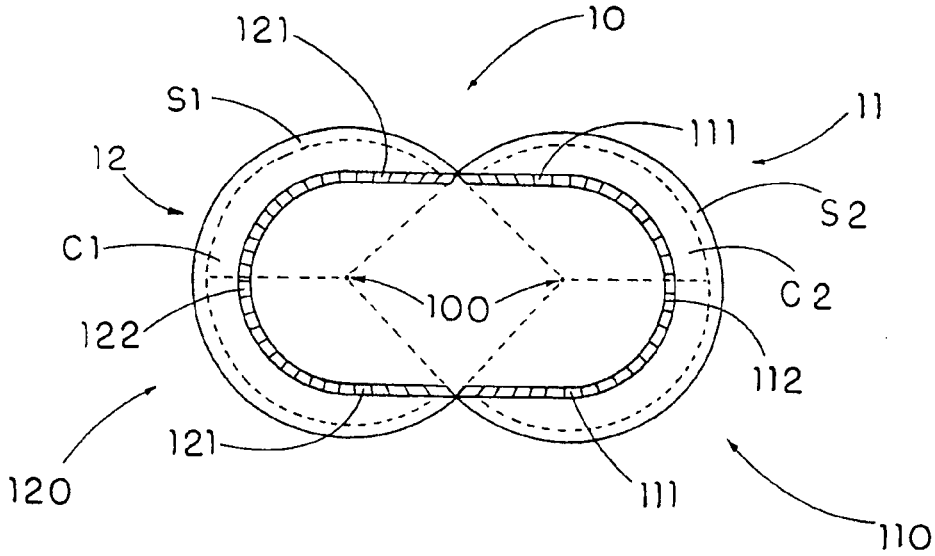
FIG. 4 is a side view of the ball cover of the golf ball according to the above preferred embodiment of the present invention.

It is worth to mention that each of the continuous first joint edge 110 of the first hemispheric cup 11 and the continuous second joint edge 120 for the second hemispheric cup 12 is inclinedly extended from an inner circumferential surface to an outer circumferential surface, i.e. projecting from the center point 100 of the respective first and second hemispheric cup 11, 12, as shown in FIGS. 3 and 4. Therefore, the continuous first joint edge 110 of the first hemispheric cup 11 is fittedly engaged with the continuous second joint edge 120 of the second hemispheric cup 12 with maximum contact surface area therebetween, so as to symmetrically unite with each other to form an integral body. Moreover, the continuous first and second joint edges 110, 120 are mutually support with each other in all directions for resisting any axial separating force so as to provide a perfect spin motion of the golf ball.

Figure 6:
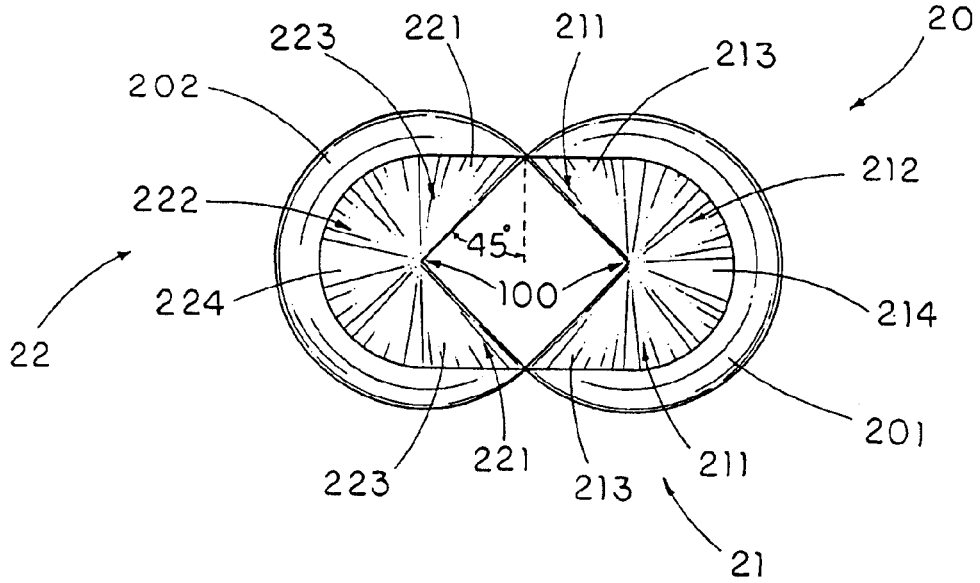
FIG. 6 illustrates the side views of the first and second core bodies of the solid ball core according to the above preferred embodiment of the present invention.

As shown in FIG. 6, the first and second core bodies 201, 202 are separated and shown in edge to edge condition so as to illustrate their symmetrical shapes, wherein four tip edges of the two first conically curved tongue surfaces 213 and the two second conically curved tongue surfaces 223 form a square space having a side equal to a radius of the spheroid formed by joining the first and second core bodies 201, 202 together.

Figure 7:
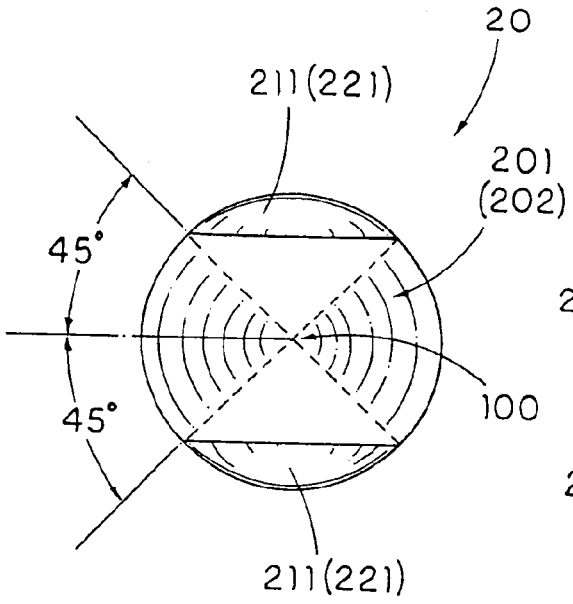
FIG. 7 is a front view of the solid ball core according to the above preferred embodiment of the present invention.
Figure 8:
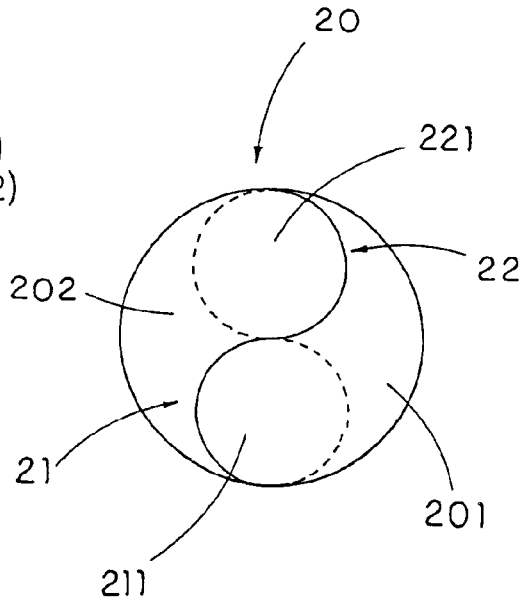
FIG. 8 is a schematic view illustrating how the first and second core bodies united together according to the above preferred embodiment of the present invention.

As shown in FIGS. 6 to 8, it is worth to indicate that the four first and second conically curved tongue surfaces 213, 223 and the four first and second conically curved groove surfaces 214, 224 are extended from a geometrical center of each of the first and second core bodies 201, 202 outwardly at 45°. When we need to combine the two core bodies 201, 202 symmetrically to form the solid ball core 20, such spheroid as disclosed above is a prefect joint structure to be used.

In order to form the first joint portion 21 for the first core body 201 or the second joint portion 22 for the second core body 202, two cone holes can be drilled at two opposing end of a sphere body coaxially to form the two semi-conical engagement grooves, wherein the cone height of each cone hole must be equal to the radius of the sphere body. Then, form a continuous groove extended between the two cone holes so as to define the two semi-conical engagement tongues projected between the two semiconical engagement grooves. Thus, the first and second core bodies 201, 202, which are made in this way and have an identical shape and size, are capable of joint together to form the spheroid of the solid ball core 20.

It is worth to mention again that, as shown in FIGS. 5 to 8, simply applying an axial pressure to push the first and second core bodies 201, 202 towards each other, the first and second joint portions 21, 22 will be firmly joined together to form the spheroid of the solid ball core 20, wherein the first joint surface 210 and the second joint surface 220 are also fittingly met with each other.

Again, since the first and second joint portions 21, 22 share the common center point 200 and all contacting surfaces of the first and second joint portions 21, 22 are curved and smooth surfaces extended outwardly and radially at 45° from the center point 200 to the circumference of the solid ball core 20, the first portion 21 is intercrossed with the second portion 22 that the first and second semi-engagement tongues 211, 221 are respectively engaged in the second and first semi-engagement grooves 222, 212 with maximum contact surface area therebetween, so as to symmetrically unite with each other to form the spheroid, wherein each of the first and second semi-conical engagement tongues 211, 221 is embraced by the respective second and first semi-conical engagement groove 222, 212, so that all the 45° inclined engaging surfaces contacting between the first and second joint portions 21, 22 mutually support with each other in all directions. When adhesive is applied to the first and second joint surfaces 210, 220, the first and second core bodies 201, 202 will be unite to an integral spherical body, i.e. the spheroid, having minimized friction between the first and second joint surfaces 210, 220 and minimized stress in the first and second joint portions 21, 22 during rotation and impacts.

The ball solid core 20 is adapted for being covered by the conventional ball cover having two hemispheric cups S1, S2, as shown in FIG. 1, to form the golf ball, wherein the center of the conventional ball cover S1, S2 is the center point 100 of the ball solid core 20. Ideally, the ball solid core 20 is formed by the first and second core bodies 201, 202 and the ball cover 10 is formed by the first and second hemispheric cups 11, 12 wherein the ball solid core 20 is covered by the ball cover 10 and share the common center point 100 to form the golf ball.

What is claimed is:

1. A method of manufacturing a golf ball, comprising the steps of:

(a) providing a solid ball core;

(b) providing a first hemispheric cup which cup has two identical first semi-conical engagement edges symmetrically outwardly projecting at two sides thereof and two identical first semi-conical connection edges inwardly projecting between said two first semi-conical engagement edges, wherein said two first semi-conical engagement edges are symmetrically and continuously extended between said two first semi-conical connection edges so as to form a continuous first joint edge for said first hemispheric cup;

(c) providing a second hemispheric cup which has two identical second semi-conical engagement edges symmetrically outwardly projecting at two sides thereof and two identical second semi-conical connection edges inwardly projecting between said second first semi-conical engagement edge, wherein said two second semi-conical engagement edges are symmetrically and continuously extended between said two second semi-conical connection edges so as to form a continuous second joint edge for said second hemispheric cup, wherein a cone height of each of said first and second semi-conical engagement edges is equal to a cone height of each of said first and second semi-conical connection edges, and a size and shape of said first hemispheric cup and the second hemispheric cup are identical and symmetrical;

(d) placing said solid ball core between said first hemispheric cup and said second hemispheric cup; and (e) integrally attaching said first hemispheric cup and said second hemispheric cup together by fittingly engaging said two second semi-conical engagement edges with said two first semi-conical connection edges respectively while fittingly engaging said two second semi-conical connection edges with said two first semi-conical engagement edges respectively so as to form a ball cover covering said solid ball core.

2. The method, as recited in claim 1, wherein in the step (c), said cone height of said first and second semi-conical engagement edges and said first and second semi-conical connection edges is equal to a radius of said first and second hemispheric cups.

3. The method, as recited in claim 1, wherein said first and second hemispheric cups share a common center point and all said first and second semi-conical engagement edges and said first and second semi-conical connection edges are curved and smooth edge surfaces extended radially from said center point to a circumference of said ball cover, wherein said continuous first joint edge of said first hemispheric cup is intercrossed with said continuous second joint edge of said second hemispheric cup that said first and second semi-conical engagement edges are respectively engaged with said second and first semi-conical connection edges.

4. The method, as recited in claim 2, wherein said first and second hemispheric cups share a common center point and all said first and second semi-conical engagement edges and said first and second semi-conical connection edges are curved and smooth edge surfaces extended radially from said center point to a circumference of said ball cover, wherein said continuous first joint edge of said first hemispheric cup is intercrossed with said continuous second joint edge of said second hemispheric cup that said first and second semi-conical engagement edges are respectively engaged with said second and first semi-conical connection edges.

5. The method, as recited in claim 1, wherein the step (a) further comprises the steps of:

(a-1) providing a first core body having a first joint portion which comprises two identical first semi-conical engagement tongues symmetrically projecting at two sides thereof so as to define two identical first semi-engagement grooves symmetrically indented between said two first semi-conical engagement tongues, wherein said two first semi-conical engagement tongues respectively define two first conically curved tongue surfaces symmetrically facing with each other, and said two first semi-conical engagement grooves respectively define two first conically curved groove surfaces symmetrically and continuously extended between said two first conically curved tongue surfaces, so as to form a continuous first joint surface for said first joint portion;

(a-2) providing a second core body having a second joint portion which comprises two identical second semi-conical engagement tongues symmetrically projecting at two sides thereof so as to define two identical second semi-engagement grooves symmetrically indented between said two second semi-conical engagement tongues, wherein said two second semi-conical engagement tongues respectively define two second conically curved tongue surfaces symmetrically facing with each other, and said two second semi-conical engagement grooves respectively define two second conically curved groove surfaces symmetrically and continuously extended between said two second conically curved tongue surfaces, so as to form a continuous second joint surface for said second joint portion, wherein a cone height of each of said first and second semi-conical engagement tongues is equal to a cone height of each of said first and second semi-conical engagement grooves, and thus a size of the shape of said first joint portion and said second joint portion are identical and symmetrical;

(a-3) fittingly engaging said two second semi-conical engagement tongues in said two first semi-conical engagement grooves respectively while fittingly engaging said first semi-conical engagement tongues in said two second semi-conical engagement grooves respectively; and (a-4) attaching said first core body and said second core body by integrally attaching said first joint portion and said second joint portion together to form said solid ball core.

6. The method, as recited in claim 4, wherein the step (a) further comprises the steps of:

(a-1) providing a first core body having a first joint portion which comprises two identical first semi-conical engagement tongues symmetrically projecting at two sides thereof so as to define two identical first semi-engagement grooves symmetrically indented between said two first semi-conical engagement tongues, wherein said two first semi-conical engagement tongues respectively define two first conically curved tongue surfaces symmetrically facing with each other, and said two first semi-conical engagement grooves respectively define two first conically curved groove surfaces symmetrically and continuously extended between said two first conically curved tongue surfaces, so as to form a continuous first joint surface for said first joint portion;

(a-2) providing a second core body having a second joint portion which comprises two identical second semi-conical engagement tongues symmetrically projecting at two sides thereof so as to define two identical second semi-engagement grooves symmetrically indented between said two second semi-conical engagement tongues, wherein said two second semi-conical engagement tongues respectively define two second conically curved tongue surfaces symmetrically facing with each other, and said two second semi-conical engagement grooves respectively define two second conically curved groove surfaces symmetrically and continuously extended between said two second conically curved tongue surfaces, so as to form a continuous second joint surface for said second joint portion, wherein a cone height of each of said first and second semi-conical engagement tongues is equal to a cone height of each of said first and second semi-conical engagement grooves, and thus a size of the shape of said first joint portion and said second joint portion are identical and symmetrical;

(a-3) fittingly engaging said two second semi-conical engagement tongues in said two first semi-conical engagement grooves respectively while fittingly engaging said first semi-conical engagement tongues in said two second semi-conical engagement grooves respectively; and (a-4) attaching said first core body and said second core body by integrally attaching said first joint portion and said second joint portion together to form said solid ball core.

7. The method, as recited in claim 5, wherein said cone height of said first and second semi-conical engagement tongues and said first and second semi-conical engagement grooves is equal to a radius of said first and second joint portions.

8. The method, as recited in claim 6, wherein said cone height of said first and second semi-conical engagement tongues and said first and second semi-conical engagement grooves is equal to a radius of said first and second joint portions.

9. The method, as recited in claim 5, wherein said first and second joint portions share a common center point and all said first and second conically curved tongue surface and said first and second conically curved groove surfaces of said first and second joint portions are curved and smooth surfaces extended outwardly and radially from said center point to a circumference of said solid ball core, wherein said first joint portion is intercrossed with said second joint portion that said first and second semi-conical engagement tongues are respectively engaged in said second and first semi-conical engagement grooves, and said first and second semi-conical engagement tongues are embraced by said second and first semi-conical engagement grooves respectively.

10. The method, as recited in claim 7, wherein said first and second joint portions share a common center point and all said first and second conically curved tongue surface and said first and second conically curved groove surfaces of said first and second joint portions are curved and smooth surfaces extended outwardly and radially from said center point to a circumference of said solid ball core, wherein said first joint portion is intercrossed with said second joint portion that said first and second semi-conical engagement tongues are respectively engaged in said second and first semi-conical engagement grooves, and said first and second semi-conical engagement tongues are embraced by said second and first semi-conical engagement grooves respectively.

11. The method, as recited in claim 8, wherein said first and second joint portions share a common center point and all said first and second conically curved tongue surface and said first and second conically curved groove surfaces of said first and second joint portions are curved and smooth surfaces extended outwardly and radially from said center point to a circumference of said solid ball core, wherein said first joint portion is intercrossed with said second joint portion that said first and second semi-conical engagement tongues are respectively engaged in said second and first semi-conical engagement grooves, and said first and second semi-conical engagement tongues are embraced by said second and first semi-conical engagement grooves respectively.

12. The method, as recited in claim 9, wherein said first and second conically curved tongue surfaces and said first and second conically curved grooves of said first second joint portions are curved and smooth surfaces are inclined from said center point at 45°.

13. The method, as recited in claim 10, wherein said first and second conically curved tongue surfaces and said first and second conically curved grooves of said first second joint portions are curved and smooth surfaces are inclined from said center point at 45°.

14. The method, as recited in claim 11, wherein said first and second conically curved tongue surfaces and said first and second conically curved grooves of said first second joint portions are curved and smooth surfaces are inclined from said center point at 45°.

15. A method of manufacturing a golf ball, comprising the steps of:

(a) providing a first core body having a first joint portion which comprises two identical first semi-conical engagement tongues symmetrically projecting at two sides thereof so as to define two identical first semi-engagement grooves symmetrically indented between said two first semi-conical engagement tongues, wherein said two first semi-conical engagement tongues respectively define two first conically curved tongue surfaces symmetrically facing with each other, and said two first semi-conical engagement grooves respectively define two first conically curved groove surfaces symmetrically and continuously extended between said two first conically curved tongue surfaces, so as to form a continuous first joint surface for said first joint portion;

(b) providing a second core body having a second joint portion which comprises two identical second semi-conical engagement tongues symmetrically projecting at two sides thereof so as to define two identical second semi-engagement grooves symmetrically, indented between said two second semi-conical engagement tongues, wherein said two second semi-conical engagement tongues respectively define two second conically curved tongue surfaces symmetrically facing with each other, and said two second semi-conical engagement grooves respectively define two second conically curved groove surfaces symmetrically and continuously extended between said two second conically curved tongue surfaces, so as to form a continuous second joint surface for said second joint portion, wherein a cone height of each of said first and second semi-conical engagement tongues is equal to a cone height of each of said first and second semi-conical engagement grooves, and thus a size of the shape of said first joint portion and said second joint portion are identical and symmetrical;

(c) fittingly engaging said two second semi-conical engagement tongues in said two first semi-conical engagement grooves respectively while fittingly engaging said first semi-conical engagement tongues in said two second semi-conical engagement grooves respectively;

(d) attaching said first core body and said second core body by integrally attaching said first joint portion and said second joint portion together to form a solid ball core;

(e) providing a ball cover having a hollow spherical shape; and (f) covering said solid ball core by said ball cover.

16. The method, as recited in claim 15, wherein said cone height of said first and second semi-conical engagement tongues and said first and second semi-conical engagement grooves is equal to a radius of said first and second joint portions.

17. The method, as recited in claim 15, wherein said first and second joint portions share a common center point and all said first and second conically curved tongue surface and said first and second conically curved groove surfaces of said first and second joint portions are curved and smooth surfaces extended outwardly and radially from said center point to a circumference of said solid ball core, wherein said first joint portion is intercrossed with said second joint portion that said first and second semi-conical engagement tongues are respectively engaged in said second and first semi-conical engagement grooves, and said first and second semi-conical engagement tongues are embraced by said second and first semi-conical engagement grooves respectively.

18. The method, as recited in claim 16, wherein said first and second joint portions share a common center point and all said first and second conically curved tongue surface and said first and second conically curved groove surfaces of said first and second joint portions are curved and smooth surfaces extended outwardly and radially from said center point to a circumference of said solid ball core, wherein said first joint portion is intercrossed with said second joint portion that said first and second semi-conical engagement tongues are respectively engaged in said second and first semi-conical engagement grooves, and said first and second semi-conical engagement tongues are embraced by said second and first semi-conical engagement grooves respectively.

19. The method, as recited in claim 17, wherein said first and second conically curved tongue surfaces and said first and second conically curved grooves of said first second joint portions are curved and smooth surfaces are inclined from said center point at 45°.

20. The method, as recited in claim 18, wherein said first and second conically curved tongue surfaces and said first and second conically curved grooves of said first second joint portions are curved and smooth surfaces are inclined from said center point at 45°.

* * * * *